United States Patent [19]

Moulin

[11] Patent Number: 4,746,942

[45] Date of Patent: May 24, 1988

[54] PHOTOCOMPOSING MACHINE AND METHOD

[76] Inventor: Michel Moulin, Chemin du Russel, 15, CH 1-25 Saint Sulpice, Switzerland

[21] Appl. No.: 127,627

[22] Filed: Nov. 27, 1987

Related U.S. Application Data

[63] Continuation of Ser. No. 800,519, Nov. 21, 1985, abandoned.

[30] Foreign Application Priority Data

Nov. 23, 1985 [GB] United Kingdom ..... 8529629

[51] Int. Cl.[4] ..... B41B 19/00

[52] U.S. Cl. ..... 354/5

[58] Field of Search ..... 354/5

[56] References Cited

U.S. PATENT DOCUMENTS

| | | | |
|---|---|---|---|
| 3,517,592 | 6/1970 | Kollar | 95/4.5 |
| 3,568,178 | 3/1971 | Day | 340/324 |
| 3,585,296 | 6/1971 | Martin | 178/15 |
| 3,597,593 | 8/1971 | Overacker | 95/4.5 |
| 3,626,459 | 12/1971 | Haflinger et al. | 95/4.5 R |
| 3,688,033 | 8/1972 | Hell et al. | 178/15 |
| 3,692,935 | 9/1972 | Manber | 178/15 |
| 3,721,991 | 3/1973 | Kaufman et al. | 346/108 |
| 3,820,123 | 6/1974 | Ammann | 354/7 |
| 3,952,311 | 4/1976 | Lapeyre | 354/5 |
| 4,000,495 | 12/1976 | Pirtle | 354/7 |
| 4,044,363 | 8/1977 | Morgan | 354/5 |
| 4,096,486 | 6/1978 | Pfeifer et al. | 346/107 R |
| 4,277,154 | 7/1981 | Sakabinos | 354/5 |
| 4,279,483 | 7/1981 | England et al. | 354/5 |
| 4,310,226 | 1/1982 | Manber et al. | 354/5 |
| 4,316,196 | 2/1982 | Jacobs | 346/1.1 |
| 4,342,504 | 8/1982 | Ebner | 354/7 |
| 4,344,677 | 8/1982 | Stuermer et al. | 354/5 |
| 4,370,678 | 1/1983 | Kitamura | 358/285 |
| 4,378,562 | 3/1983 | Oosaka et al. | 346/1.1 |
| 4,394,076 | 7/1983 | Manber et al. | 354/5 |
| 4,419,676 | 12/1983 | Lenk et al. | 346/108 |
| 4,431,295 | 2/1984 | Moyroud et al. | 354/5 |
| 4,554,561 | 11/1985 | Daniele et al. | 346/108 |
| 4,563,747 | 1/1986 | Tidd | 364/523 |
| 4,591,880 | 5/1986 | Mitsuka | 346/108 |
| 4,617,578 | 10/1986 | Neyu et al. | 354/5 X |

FOREIGN PATENT DOCUMENTS

| | | |
|---|---|---|
| 097261 | 5/1988 | European Pat. Off. . |
| 3046397 | 7/1982 | Fed. Rep. of Germany . |
| 1201624 | 11/1967 | United Kingdom . |
| 2136733 | 3/1984 | United Kingdom . |

OTHER PUBLICATIONS

G. Wessel, "Electro-Optical Ceramic (PLZT) as Light--Gate Array for Non-Impact Printer", Research CT STD Elektrik Lorenze, W. Germ Publ. Unk.

Cutchen et al. "PLZT Electrooptic Shutters", Applns, Applied Optics, vol. 14, 8/75, pp. 1866-1873.

Ueno et al. "PLZT Spatial Light Modular for a 1-D Halogram Memory", Applied Optics, vol. 19, No. 1, 1/80, pp. 164-172.

IBM Technical Disclosure Bulletin, vol. 13, No. 12, 5/19/71, (Optical Printer).

Taylor et al. (Ferroelectric Light Valve Arrays for Optical Memories), IEEE Trans Sonics and Ultrasonics, 1972, SU-19, pp. 81-99.

Tults, "A Facsimile Printer Utilizing an Array of Liquid Crystal Cell Proceedings of the S.I.D.", vol. 12/4, 4th Qtr. 1971, pp. 199-203.

*Primary Examiner*—Michael L. Gellner

*Attorney, Agent, or Firm*—Gregor N. Neff

[57] ABSTRACT

A laser beam is widened in one dimension to cover an array of a substantial number of electro-optic gates. The beam is divided by the gates into a plurality of potential spot-forming beams. The transmission of each beam to a photosensitive surface is selectively inhibited in accordance with a pre-determined pattern or program, while the beams are swept relative to the photosensitive surface to form characters and other images. Preferably, the gates are formed by a wafer of PLZT electro-optic ceramic material, with a large number of closely-spaced electrodes on the surface, in cooperation with a crossed polarizer. Preferably, the beams are collimated and a traveling lens and reflector combination is moved parallel to the photosensitive surface in the collimated beams to space the spots on the film from one another. The collimated beams are made convergent so that a relatively small, light-weight lens can be used to compose relatively long lines of text without excessive loss of light or vignetting. Also provided are a relatively simple but stable lens-reflector carriage and rail structure on which the carriage travels in order to sweep the beam relative to the photosensitive surface.

42 Claims, 8 Drawing Sheets

Ad
X

FIG 13
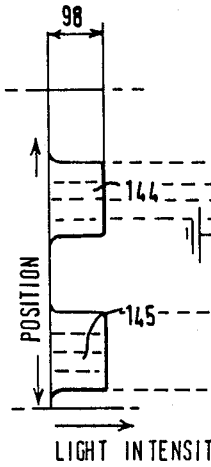
FIG 12
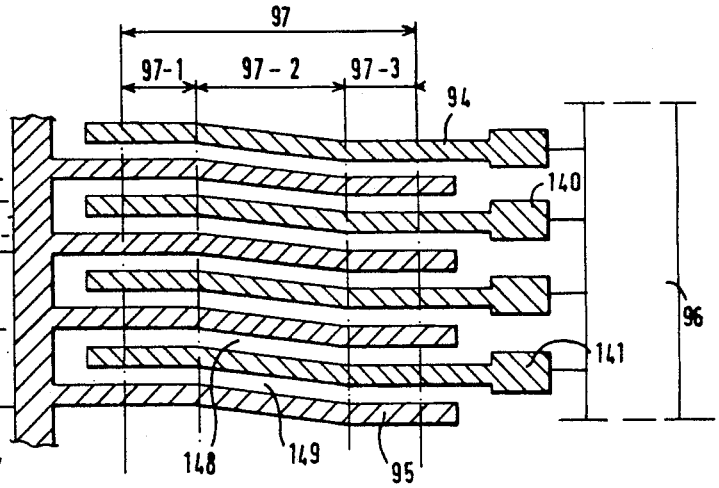
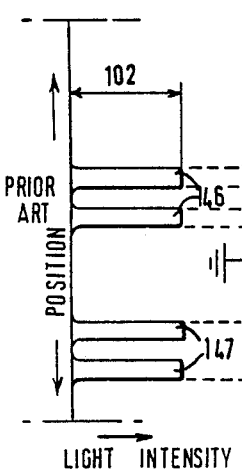
FIG 15
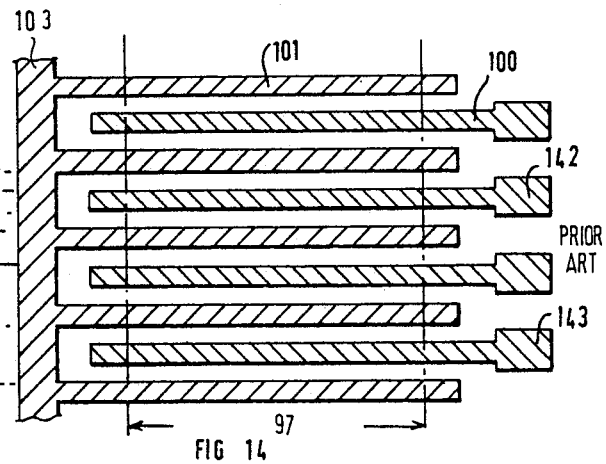
FIG 14
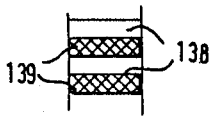
FIG 16
PRIOR ART
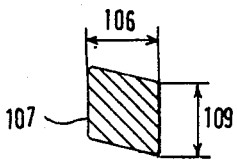
FIG 17

PHOTOCOMPOSING MACHINE AND METHOD

This application is a continuation, of application Ser. No. 800,519, filed Nov..21, 1985, abandoned.

This invention relates generally to photocomposition. More particularly, this invention relates to so-called "Fourth Generation" photocomposing machines and methods based on the use of laser light.

Prior laser photocomposing machines and methods capable of producing commercially acceptable type composition tend to be expensive and complex in construction.

Most prior "raster" type fourth-generation photocomposers utilize a rotating multi-faceted polygon-shaped mirror to scan a laser spot-forming beam across a photosensitive surface. Such machines require relatively large amounts of computer memory and relatively high computing speeds to store and retrieve the data necessary to produce acceptable composition. Such machines also require the maintenance of stringent mechanical and optical tolerances. For example, there is the mechanical problem associated with the wobbling of the rotating polygon, the accuracy of the polygon reflecting facets such as facet pitch angle, facet-to-facet errors and facet-to-spin axis errors and other mechanical problems. The optical problems to be dealt with are no less serious and costly, and they increase considerably as the desired length of lines of text increases.

Various means have been proposed to solve or alleviate the latter problems, such as the use of lenses of special design to insure a flat field, and a linear relationship between the angular displacement of the polygon-reflected beam and the focused spot in the flat image field and also to prevent the size of the spot from increasing as it approaches the ends of the text line. Other means, such as the use of toroidal lenses, curved mirrors and the like have been proposed. All of these factors contribute to the cost and complexity of the equipment.

Other proposed fourth generation photocomposers use a series of acousto-optic deflectors instead of a polygonal mirror. However, such photocomposers still do not solve the cost and complexity problems, and have had other significant problems.

One object of the invention is to provide a fourth generation photocomposing machine and method which have high versatility, high speed and productivity, and very good to excellent composition quality to faithfully reproduce original type designs, and yet are relatively low in cost; a machine and method which solve or greatly alleviate the foregoing problems.

It is another object of the invention to provide such a machine which is compact enough to fit into the top of an ordinary desk.

A further object of the invention is to provide such a machine which can be an adjunct to existing microcomputers with appropriate interface and software for office environments.

An additional object of the invention is to provide such a machine and method in which a high level of light intensity is available to produce photocomposed text and graphics on a variety of photosensitive recording media, such as silver halide film or paper, zinc oxide plates or paper, or even plain paper. The proposed machine and methods preferably should be able to supply enough energy to expose printing plates of various kinds, thus enabling one to produce printing plates directly.

Yet another object of the invention is to provide a relatively simple mechanism and method capable of producing relatively long lines of textual or pictorial elements without excessive loss of light or vignetting.

An additional object of the invention is to provide such a machine in which very few adjustments need be made manually in order to keep the quality of the photocomposition output at a relatively high level.

A further object of the invention is to provide a compact photocomposing machine with very few moving parts yet capable of producing long lines of text of constant quality from one end to the other with simple optical means.

In accordance with the present invention, the foregoing objectives are met by the provision of a photocomposing machine and method in which a relatively wide laser beam is formed and modulated so as to divide it into a series of small, thin spot-forming beams. The transmission of each of the small beams to a photosensitive surface is controlled while the beam is swept relative to the photosensitive surface so as to form images from the spots.

Preferably, the small, thin beams are aligned to form one or more lines of contiguous or overlapping spots, the length of the lines varying with the position of the beams relative to the photosensitive recording surface.

It also is preferred that the modulator be an electro-optic device such as a PLZT ceramic wafer with an plurality of interleaved electrodes, which, together with a crossed polarizer, forms an array of very small light gates. Preferably, the spots are made contiguous or overlapping by making different lateral portions of each electrode offset from the other.

The beam preferably is swept relative to the recording surface by the use of a collimator and a traveling lens and reflector. Preferably, the collimated beams are made convergent to avoid excessive loss of light or vignetting when composing relatively long lines of text with a focusing lens of moderate size. Also, the beam transmitted preferably are transmitted on or very close to the optical axis of the device, in at least one plane.

The lens and reflector are mounted for travel on a pair of rails. A simple but accurate rail support structure is formed by a simple beam with walls forming two angles, and a rail member fitted into each angle. A simple extruded aluminum channel beam can be used.

The carriage is maintained accurately in position on the rails by the use of a bearing member engaging one rail, a tapered roller engaging the other rail, and resilient means urging the roller and bearing member against the rails.

Each vertical line of spots representing a small slice of a pre-selected character is projected at a substantially reduced size onto the photosensitive media along the optical axis of the relatively simple lens assembly so that relatively long lines of high quality images can be produced at a relatively low cost. The machine also is relatively compact and simple, and fully meets the objects set forth above.

The invention is further explained and described with reference to the accompanying drawings, in which.

Figures 1, 2, 3:
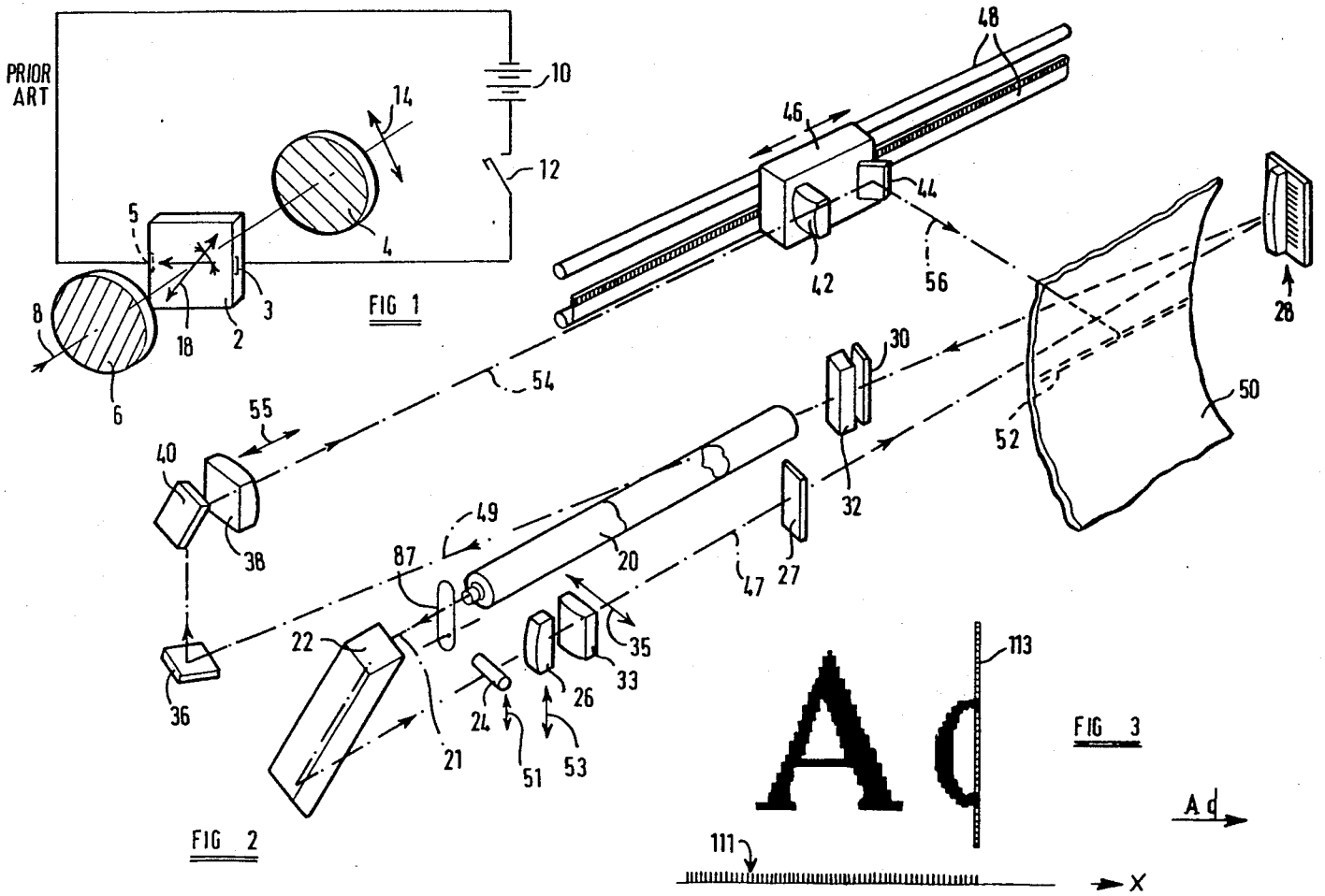
PRIOR ART FIG 1
FIG. 1 represents schematically a know principle utilized in the present, invention in a new manner.
FIG. 2 is a simplified, partially schematic perspective view of the preferred photographic unit of a photocomposing machine constructed in accordance with the invention.
FIG. 3 illustrates the gradual formation of a character on the photosensitive media by use of the unit shown in FIG. 2.
Figure 6:
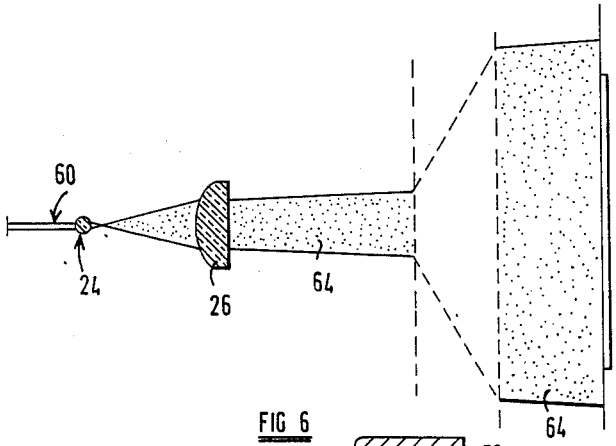
Figure 7:
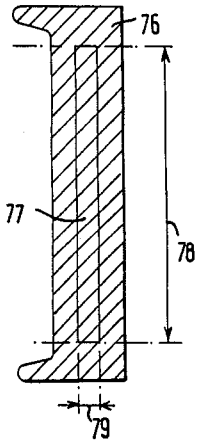
Figure 9:
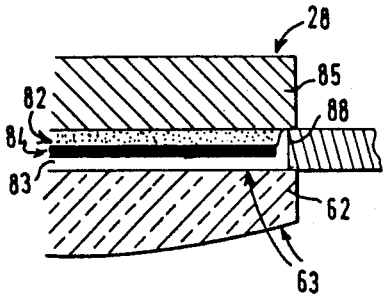
Figure 11:
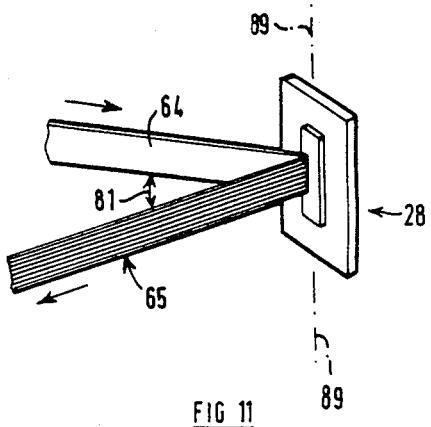
Figure 8:
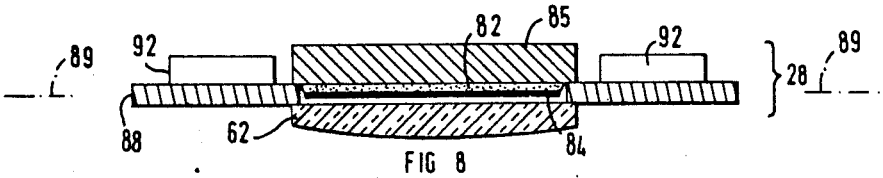
Figure 10:
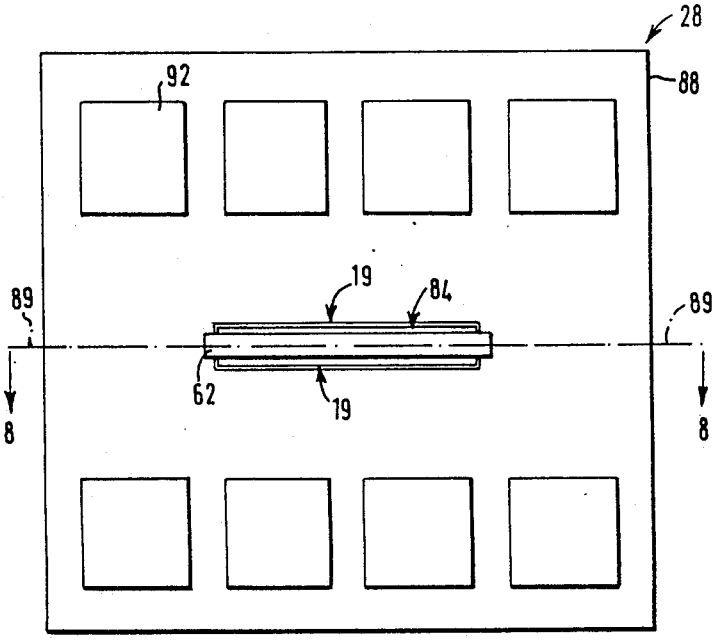
Figure 18:
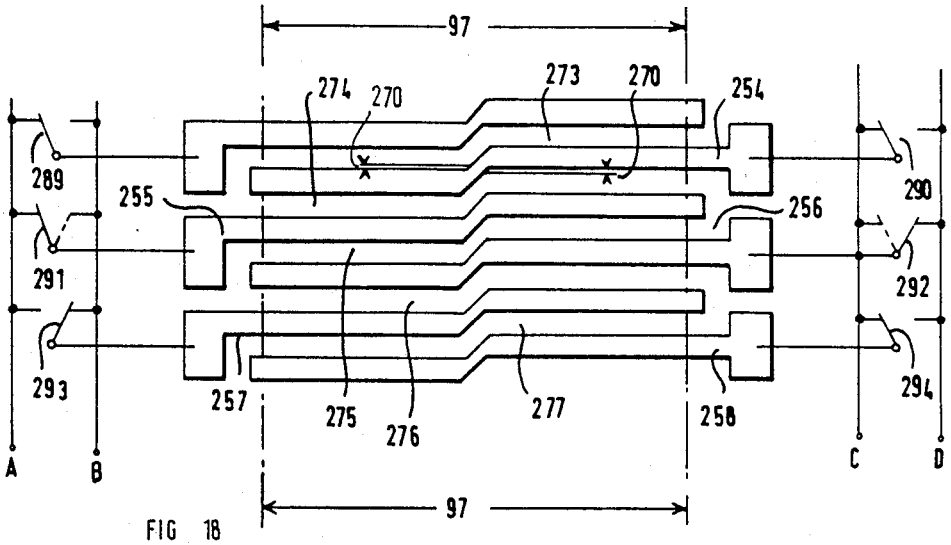
Figure 19:
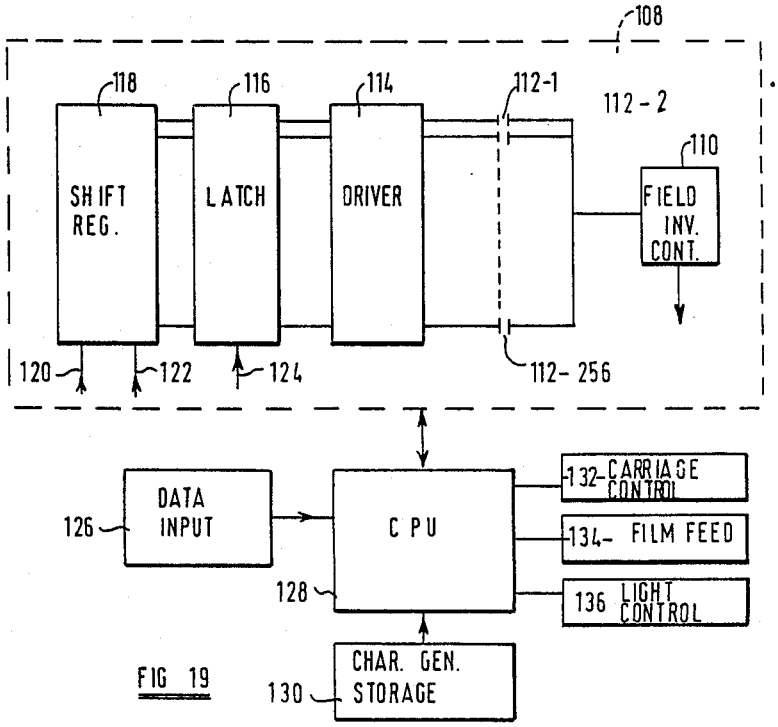
Figure 20:
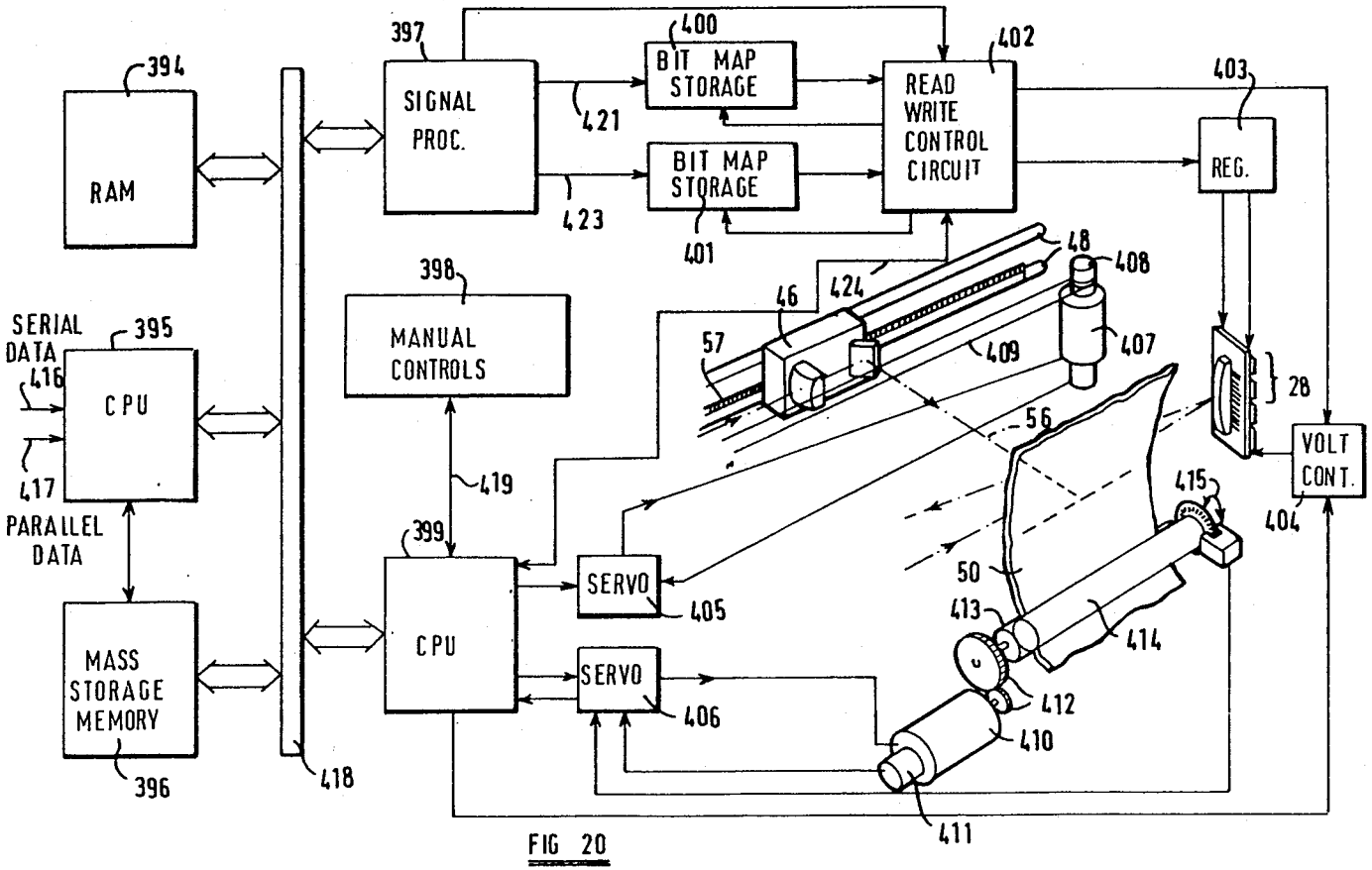
Figures 21, 22:
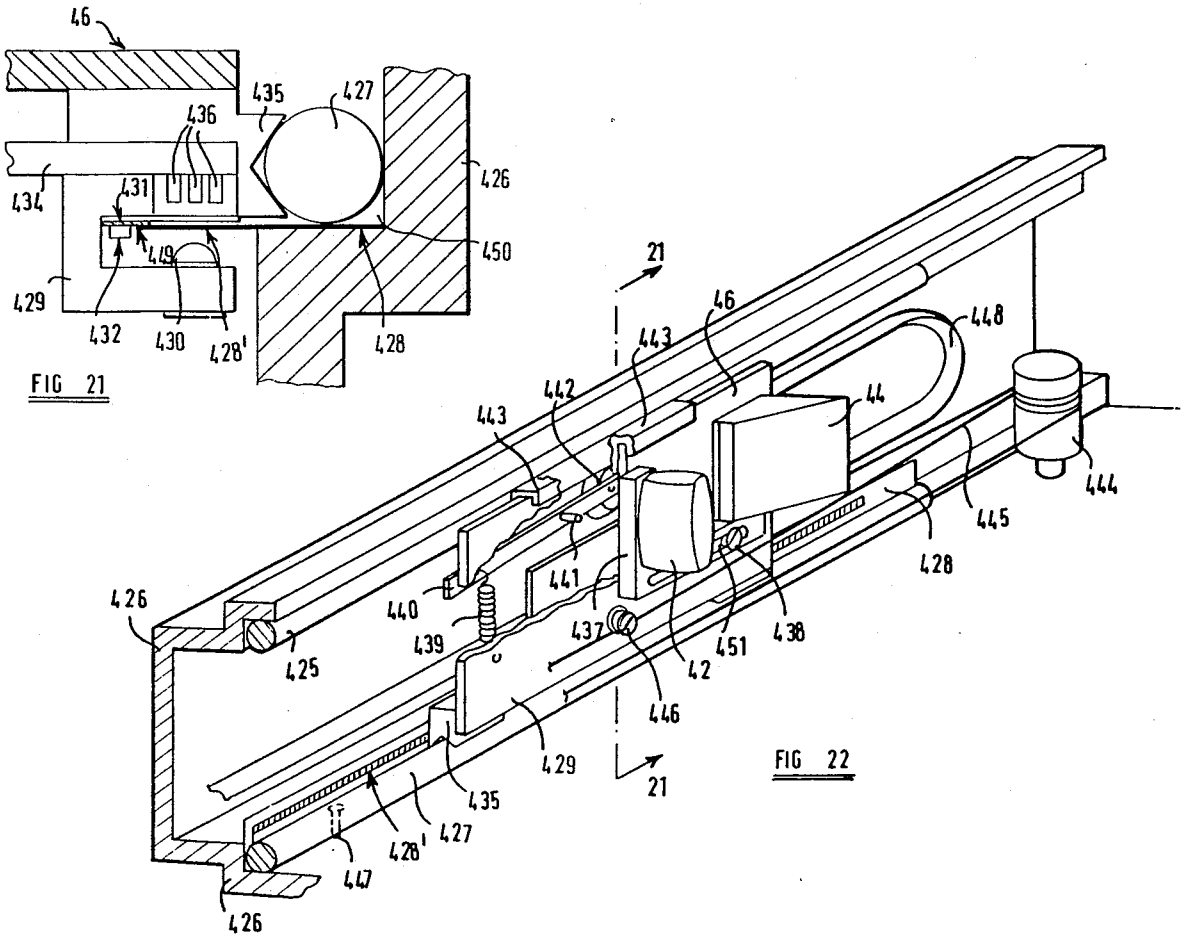

FIG. 6 schematically represents the optical components used in the unit of FIG. 2;

FIG. 7 is a cross sectional view, taken along line 7—7 of FIG. 6;

FIG. 8 is a cross-sectional view taken along line 8—8 of FIG. 10, showing the light modulator assembly of the FIG. 2 unit;

FIG. 9 is an enlarged view of a portion of FIG. 8;

FIG. 10 is a schematic plan view of the light modulator assembly of the FIG. 2 unit;

FIG. 11 is a schematic perspective view illustrating the shape of the ribbon-like light bundle entering the light modulator assembly of FIGS. 8–10 and the reflected modulated light ribbon;

FIG. 12 is an enlarged, partially schematic elevation view of an arrangement of the electrodes defining individual coterminous elementary areas on the light modulator of FIGS. 8–10;

FIG. 13 is a schematic diagram illustrating one advantage of the electrodes shown in FIG. 2;

FIG. 14 is a view like FIG. 12 showing a prior art arrangement of electrodes;

FIG. 15 is a schematic diagram, like FIG. 13, showing one of the defects of the arrangement of FIG. 14;

FIG. 16 is a schematic view of a spot which might be obtained from the prior art arrangement of FIG. 14;

FIG. 17 is a schematic view of a spot which can be obtained with the improved arrangement of FIG. 12;

FIG. 18 is a schematic view of a preferred arrangement of the controlling electrodes on the light modulator of FIGS. 8–10;

FIG. 19 is a block diagram of the electronic control circuit for the photocomposing machine of the invention;

FIG. 20 is a more detailed block diagram of the circuit shown in FIG. 19;

FIG. 21 is a cross-sectional, partially broken-away view taken along line 21—21 of FIG. 22; and FIG. 22 is a perspective schematic view of the movable carriage of the unit shown in FIG. 2.

TECHNOLOGICAL BACKGROUND

FIG. 1 of the drawings illustrates one of the principles used in the present invention. In the preferred embodiment of the invention, an elongated transparent wafer 2 of lanthanum-modified lead zirconate titanate (PLZT) ceramic material is utilized. This material has electro-optic properties and operates as follows.

A beam of light 8 from an unpolarized light source (not shown) is polarized in a first plane 18 by a first polarizer 6. With the switch 12 open so that the voltage from a source 10 is not applied to the wafer 2, the polarized light from polarizer 6 is transmitted through the wafer 2 without any change of polarization. A second polarizer 4 receives the light transmitted through the wafer 2. The plane 14 of polarization of the polarizer 4 is rotated 90° with respect to the polarization plane 18 of the first polarizer 6 so that no light passes through the polarizer 4. The wafer 2 is provided with two opposite electrodes 3 and 5. When the switch 12 is closed a voltage is applied to the electrodes from the source 10 in order to create an electric field through the wafer. The wafer 2 then acts as an optical retarder, shifting the relative phases of light polarized parallel and perpendicular to the applied field. With the proper electric field, the wafer behaves as a half-wave retardation plate, rotating the plane of polarization by 90°, from plane 18 to 14, so that light is transmitted through the second polarizer 4. Thus, the device shown in FIG. 1 is an electro-optic shutter which either transmits or blocks the transmission of light. For further details see: "PLZT Electro-optic shutters"- Applied Optics, Vol. 14, page 1866, August 1975.

OPTICAL SYSTEM-GENERAL DESCRIPTION

The major optical opponents of the photocomposer are shown in FIG. 2, which is a schematic representation. A laser light source 20 such as a He-Ne laser produces a constant, polarized narrow beam 21 of light. The beam 21 is deflected approximately 180 degrees by a retro-reflector prism 22. The beam emerging from the prism passes through a first cylindrical lens 24 which, in association with a second cylindrical lens 26 of smaller convergence, spreads the beam 21 vertically, and shapes the beam into an elongated, wide ribbon-like beam of light parallel to the vertical plane. The beam is made slightly diverging in the horizontal plane by a cylindrical lens 33 for reasons to be explained hereinafter. The output from laser source 20 preferably is polarized. However, an additional polarizer 27 is located at the output of lens 33 in order to correct any change of polarization introduced by the passage of light through the preceding optical elements.

From lens 33 and polarizer 37 the shaped beam of light is directed to a modulator assembly 28 including a mirror from which the modulated beam is reflected to a crossed polarizer 30 which blocks selected ones of the light rays corresponding to unactivated elementary areas of the modulator, as it will be explained in greater detail below. The beams of light emerging from the polarizer 30 are spread horizontally by a cylindrical lens 32 and are deflected by mirrors 36 and 40 toward a spherical collimator lens 38. Lens 32, being cylindrical, has no effect on the rays parallel to the vertical plane.

The collimator lens 38 is located at an optical distance from the reflective surface of the modulator 28 substantially equal to its focal length and therefore produces collimated rays shown at 54 in FIG. 2. Those rays reach a spherical imaging lens 42 and mirror 44, both of which are mounted on a slidable carriage 46. The lens 42 and mirror 44 move along a path defined by rails 48 at constant distance from film 50. That distance is determined so that lens 42 always forms an image 52 of reduced size on the film regardless of the position of the lens and mirror along their path of movement. Preferably, one line of text is produced by movement of the lens and mirror combination in one direction, and another when it reverses its motion to move in the opposite direction.

A mechanical shutter shown schematically at 87 is moved into active position to intercept the laser beam 21 during relatively long periods between successive operations of the phototypesetter.

A character spacing mechanism utilizing collimated light and traveling focusing lens and reflector is known in the art, but the present invention makes it possible to reduce the mass of the optical components on the carriage, thus decreasing its size and weight and making it possible to move it at a relatively high speed, particularly since it moves in a continuous fashion, first in one direction, then in the opposite direction. Another notable feature of the invention is the fact that the production speed, expressed in lines per minute, can be higher for shorter lines than for long lines because the carriage displacement can be varied with the length of the lines of text, which is not the case in systems utilizing a continuously rotating multi-faceted polygon, such devices must scan the light beam across the full width of the character receiving area on the film, as if the maximum length line were being composed, even if the actual length of line is much shorter.

MODULATOR

The structure and mode of operation of the modulator 28 is illustrated in FIGS. 8 through 18.

Referring first to FIGS. 8–10, the modulator 28 includes a spherical plano-convex lens 62 cut off at the sides to form an elongated rectangular outline, a PLZT wafer 84, and a front-surfaced mirror 85. The wafer 84 is secured to the front surface of the mirror 85 by means of a transparent gel 82 which is flexible to allow the wafer 84 to expand and contract as it tends to do. The lens 62 is mounted with its planar rear surface parallel to and close to the wafer 84, and the assembly is secured with the wafer 84 in a hole 19 in a printed circuit board 88 by appropriate mounting means (not shown). Also mounted on the printed circuit board 88 are integrated circuit chips 92 forming the driving circuitry for the modulator.

FIGS. 8 and 9 are vertical cross-sectional views, with the vertical plane being aligned or parallel to the line 89 in FIGS. 8–11. Thus, the vertical plane is aligned horizontally in FIGS. 8–10. However, the modulator assembly 28 is shown rotated 90° in FIG. 11 so as to illustrate the entering light rays 64 and the leaving light rays 65 and the angle 81 between them. Angle 81 is greatly exaggerated in FIG. 11 for the sake of clarity in the drawings. Actually, the angle 81 is small, so that the entering and leaving light rays pass through substantially the same area of the wafer 84.

Referring to FIG. 9, both outside surfaces 63 of the lens 62 are covered with an anti-reflection coating of appropriate composition for the characteristics of the traversing light. A small air gap 83 is left between the flat surface of the plano-convex segment and the PLZT wafer shown at 84. The surface of the wafer 84 which faces the lens is also covered with the appropriate anti-reflection coating. Controlling electrodes, to be described below, are located on the opposite surface of the wafer 84—that is, on the surface attached to the mirror 85.

The light rays 64 entering the assembly 28 pass through the PLZT wafer 84 twice, entering the lens 62, then passing through the wafer 84 and the gel coat 82 a first time, and being reflected from the reflecting surface of mirror 85 along a path slightly angled relative to the entering path but passing through substantially the same elementary area of the wafer, then proceeding through the lens 62 to emerge as rays 65.

The exiting rays 65, as explained above, go through the polarizer 30. The combination of the modulator 28 and the polarizer 30 comprise a light shutter unit—an array of small, closely-spaced light gates.

The control electrodes on the PLZT wafer 84 are shown in FIGS. 12 and 18. The electrodes are very small and preferably are produced by photolithography.

The manner of operation of a PLZT device with thin, parallel closely-spaced electrodes will be explained with references to FIGS. 14 and 15. Input electrodes 100, 142, 143, etc., are interleaved between adjacent arms such as arms 101 and 105 which are joined together by a common electrode 103 which is connected to ground. When an electrical signal is applied to one of the input electrodes such as the upper electrode 100, this creates an electric field in the PLZT material in the zones between the input electrode 100 and the adjacent grounded electrodes 101 and 105 and rotates the plane of polarization of light transmitted through those zones.

If the device of FIG. 14 were used as in the modulator in the photocomposing machine and method of the present invention, with light shining on the zone 97, and if, for example, electrodes 142 and 143 were energized with a voltage high enough to rotate the plane of polarization of the incident light sufficiently, each of the two zones on the sides of each input electrode would, in effect, become an "open" half-window, allowing light passing through those zones to pass through the polarizer 30 and the other downstream optical elements and onto the film 50.

FIG. 15 is a waveform diagram plotting the intensity of light transmitted through the polarizer 30 versus position along the length of the wafer 84. Thus, FIG. 15 shows two light peaks 146 or 147 for each electrode, with an obscured zone between. The final result on the film or other photosensitive medium will be a spot, shown schematically in FIG. 16, comprised of two "light" spots 139 with two "dark" spots 138.

It is a feature of the invention to provide electrodes shaped and located as shown in FIG. 12. Each electrode, having a useful length represented by 97, is composed of two horizontal sections 97-1 and 97-3 of equal length joined by a slanted section 97-2 approximately twice the length of sections 97-1 and 97-3 so that the light going through the "open" half-windows or gates adjacent to electrodes 140 and 141 has the waveform 144 or 145 as shown in FIG. 13. Although the intensity 98 of light of the areas 144 and 145 is lower than the intensity 102 in the FIG. 14 device, the total amount of light, represented by areas 144 and 145, is equal to the total amount of light represented by areas 146 and 147 of FIG. 13. The difference is that the device of FIG. 12 produces a single spot with no dark areas.

FIG. 17 represents (approximately) one spot or dot 107 of a light column as produced on the film by one energized electrode of FIG. 12, for example, electrode 141, which opens gates 148 and 149. The dot 107 has a height proportional to four times the width of the electrodes and spaces, assuming that those widths are equal (see FIG. 13). Ideally, the dot shown in FIG. 17 has a width 106 of approximately 20 microns and an equal height 109. The fact that electrodes arranged as in FIG. 12 produce dots with slanted upper and lower edges is of no importance since the protruding corner shown on the right side of the dot 107 is only one electrode width lower than the left side corner, divided by the reduction ratio of the optical system, only about 5 microns on the film.

It should be understood that the incident light beam 64 covers the entire effective zone 97 of the electrodes. Therefore, the light rays forming one dot are transmitted through a zone whose width is much larger than its height. However, the width of the resulting light area is reduced by the optical system to produce a dot whose dimensions are substantially symetrical.

It also should be understood that the electrodes and wafer structure shown in FIGS. 12 and 18 are greatly enlarged, and that only a few of a much greater number of electrodes are shown in the drawings, for the sake of clarity of illustration. Actually, in a typical wafer, there are enough electrodes to form 256 windows or gates. This produces more than 1,000 spots or dots per inch for each vertical dot array on the film and thus produces lines of excellent quality.

FIG. 18 shows a preferred arrangement of the electrodes controlling the gates of the PLZT light modulator 24. In this arrangement, both the electrodes and the spaces between them are twice as wide as in the arrangement of FIG. 12. For example they are approximately 140 microns or 0.14 mm wide. One of the advantages of this arrangement is that it increases the distance between consecutive electrodes. This makes the wafer less costly to manufacture. Also, it has been found that the large electrodes and larger windows or spaces provide a higher contrast ratio, that is, there is better contrast between "open" and "closed" gates or windows. This decreases cross-talk and also, because of the wider windows, the divergence of diffracted rays is reduced, which reduces the size of the imaging optics as well as giving higher image quality.

The arrangement of FIG. 18 also differs from the arrangement of FIG. 12 in that the left electrodes, represented by odd reference numbers 253, 255 and 257, are single elements electrically isolated from one another and having terminals which permit individual electrodes to be connected to different voltage sources or circuits. Thus, for example, the left electrodes can be selectively connected to voltage source A or B by the energization of switches 289, 291 and 293, and the right electrodes 254, 256 and 258 can be selectively connected through switches 290, 292 and 294 to voltage sources C and D. In the embodiment of FIG. 18, window 276 has been "opened" by the simultaneous actuation of switches 293 and 292 which creates an appropriate difference of potential between the electrodes 256 and 293.

It has been found experimentally that, by the proper selection of the control voltages, the voltage difference between electrodes of unselected gates is of negligible significance and does not create fogging of the usual photosensitive material.

To explain the foregoing further, when a voltage $V_1$ is applied to an input electrode such as the electrode 254 in FIG. 18, and electrode 253 is grounded, the voltage difference between electrodes 253 and 254 is $V_1$, a voltage sufficient to give an adequate amount of rotation of the polarization plane of light transmitted through the gate 273. However, if electrode 255, which is located on the other side of electrode 254, also were grounded, then the same voltage potential $V_1$ would be established between electrodes 353 and 255, and the gate 274 will be opened inadvertently. To prevent this from happening, there is applied to electrode 255 a voltage $V_2$ which is substantially greater than zero but substantially less than $V_1$, so that the voltage difference between electrodes 255 and 254 is insufficient to create a degree of rotation of the polarization plane adequate to open the gate 274. This same arrangement is used for all of the gates on the wafer.

The way in which the switches of FIG. 18 operate to assure independent opening and closing of each gate is that the full voltage $V_1$ is applied only to line D, and the lower voltage $V_2$ (e.g., $\frac{1}{2}$ of $V_1$) is applied to each of lines A and C, while line B is grounded. The switch contacts normally are in the left-most position, where they make contact with lines A or C. When it is desired to open one of the gates, the switch contacts for the electrodes (e.g., 253 and 254) above and below the gate area (e.g., 273) both are moved simultaneously to their right-most positions, where they contact lines B and D, respectively. This grounds one electrode and applies the full voltage $V_1$ to the other, thus opening the gate. In the meantime, the voltage applied to the electrode below electrode 254 is at $\frac{1}{2}V_1$ so that gate 274 does not open and the degree of polarization change is not enough to allow light to leak through and produce fogging of the film.

The proper value of $V_2$ can be selected experimentally. A value of $\frac{1}{2}$ of $V_1$ has proven satisfactory in a machine which has been built and tested.

It should be understood that the switches shown in FIG. 18 are shown for the purpose of explanation. Actually, similar functions are performed by driving circuitry forming part of the electronic control system to be described below.

Another difference between the arrangement of FIG. 12 and FIG. 18 is that the sloping portion of each electrode in FIG. 18 is much shorter than it is in FIG. 12. However, the electrodes are shaped to obtain the same advantage as in FIG. 12, that is, to avoid open spaces between adjacent dots on the film.

Actually, the tops of the right-hand spaces such as 273 and 277 are higher than are the bottoms of the left-hand spaces associated with the adjacent electrode by a distance 270 so that vertically adjacent dots overlap one another slightly to form sold, dark lines on the film. The horizontal spacing of the vertical lines of dots also is selected so that horizontally adjacent dots overlap slightly, for the same purpose.

CHARACTER FORMATION

FIG. 3 shows schematically an enlarged vertical column 113 of elemental areas, each representing a dot or the absence of a dot formed by the optical system of the invention, using the modulator 24 and other components described above.

In effect, the column 113 is moved rapidly from left to right, in the X direction, as shown in FIG. 3, by the rapidly-moving carriage 46 (FIG. 2). The presence or absence of a dot in each elemental area is changed in synchronism with timing pulses 111 in accordance with a previously-stored set of instructions or program to form characters such as the capital "A" and a portion of a lower-case "o" shown in FIG. 3. The same characters are shown in the right-hand portion of FIG. 3 as they might appear on the film, after an approximately 7 to 1 reduction in size by the optical system to effectively smooth the edges of the characters and improve their quality.

The width of the sweep path of the light beam in a machine which has been built and successfully tested is approximately five and one half millimeters or 15.8 points. Thus, in one sweep a whole line of characters of up to over 15 points in size is composed. Larger characters, up to over 30 points, can be composed in two separate passes, and even larger characters can be composed with the use of more passes or larger PLZT wafers, etc. If desired, two full lines or more of relatively small (e.g., 6 points) characters can be composed in one pass.

Of course, an observer looking at unit 28 through the crossed polarizer 30 would see only a vertical column of line segments composed of luminous dots, with the line segments continuously changing in length and /or intensity. Characters would appear only if the observer were rapidly moving his head in a horizontal direction.

OPTICAL SYSTEM—DETAILED DESCRIPTION

Figure 4:
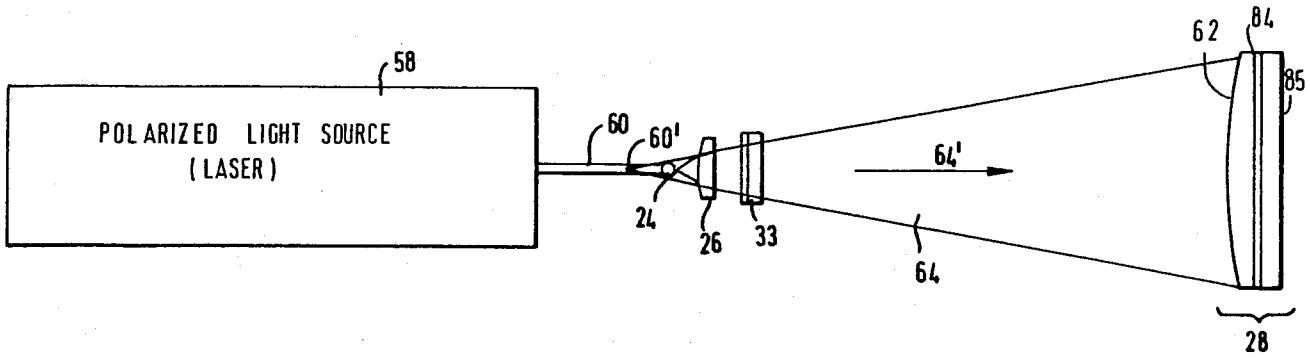
FIG. 4 is a partial section view taken in a first plane of the optical system of the unit shown in FIG. 2.
Figure 4A:
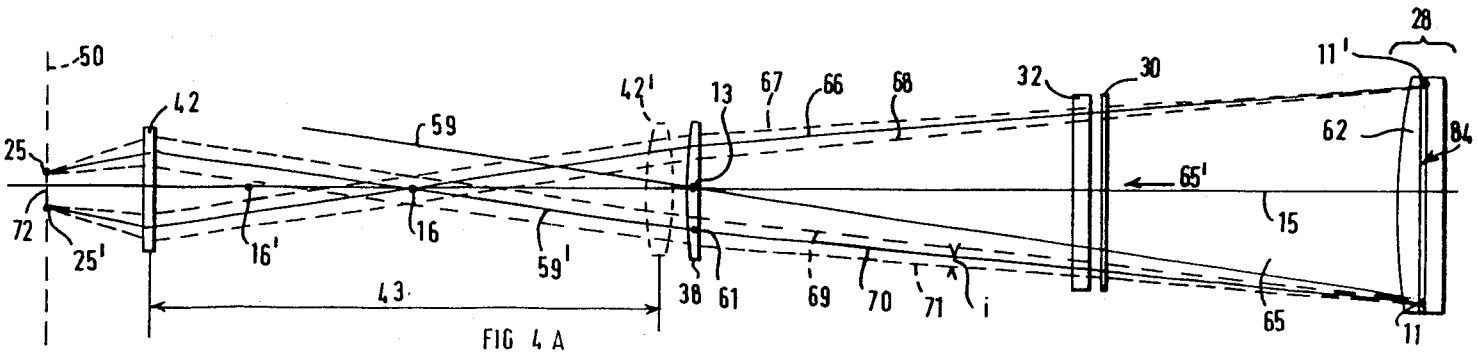
FIG. 4A is a continuation of FIG. 4.

FIGS. 4 and 4A together comprise a schematic cross-sectional view taken in the vertical plane of the optical system of FIG. 2. FIG. 4 shows the first part of the optical system from the laser source to the modulator 28, and FIG. 4A shows the second part, from the modulator 28 to the film 50.

In FIG. 4, block 58 represents the source of polarized light. In includes a laser and other components necessary to produce a polarized narrow beam of light 60. This beam first is spread vertically by the lens 24, which is a small, short focal-length cylindrical lens, e.g., a quartz rod 2 mm in diameter. The rays emerging from this first lens enter the lens 26, which is a converging cylindrical lens, to form a tapered, relatively flat generally fan-shaped light bundle 64. The virtual light source location is shown at $60^1$.

Now referring to FIG. 4A, the beam is twice modulated by unit 28, as it has been explained in detail above. The light bundle 65 leaving the modulator unit 28 contains all the necessary information to produce one vertical slice of character. It then proceeds to the polarizer 30 and the cylindrical lens 32, which has practically no effect on the light rays of the vertical plane, and is folded back by mirrors 36 and 40. Now the modulated bundle goes through spherical collimating lens 38 before reaching the travelling lens 42 which can project onto the photosensitive medium 50 a vertical column formed of a number of on-or-off spots indicated at 72 in FIG. 4A, and at 113 in FIG. 3.

Because of their size and configuration, the gates of the modulator 28 diffract the incident light. The three most significant rays are shown in FIG. 4A. The rays 66, 67 and 68 respectively represent the zero, plus one and minus one orders of the diffracted light coming from the uppermost gate of the modulator 28. Likewise, rays 70, 71 and 69 represent rays emerging from the lowest gate.

As it can be seen in the drawings, all of these rays are utilized to form an image on the photosensitive surface. A significant feature of the invention resides in the optics affecting the rays located in the vertical plane so that, as shown, a relatively small traveling lens 42 can be utilized to produce long lines (more than 840 millimeters or 200 picas) without excessive loss of light or loss of parts of the light beams (vignetting). This is quite contrary to the system commonly used in second generation machines in which the light rays emerging from a collimating lens diverge rather rapidly, thus limiting the maximum length of line and/or the maximum size of characters. The maximum length of line, as defined by the distance traveled by lens 42 (from 42') is shown at 43. Of course, the reflector 44 has been omitted from FIGS. 4 and 4A for the sake of simplicity.

The method by which such long lines can be obtained will now be explained with reference to FIGS. 4 and 4A. It is assumed that the optical system upstream of the modulator 28 has been constructed so as to obtain a substantially uniform and dimensionally acceptable light patch to cover the effective electrode area 97 (FIGS. 12 and 18) of the modulator 28. The only component of the modulator 28 which may be affected by the maximum length of line desired is the optical length of field lens 62.

The home or initial location of imaging carriage lens 42 is first determined. This location, shown at 42' in FIG. 4A, could be as close to collimating lens 38 as possible. Then, the extreme location of lens 42, shown in solid lines in FIG. 4A, is determined from the maximum length of line desired, represented by distance 43. Point 16, on the optical axis 15, is located at the midpoint of the zone 43 of maximum travel of lens 42.

Now, going back to the PLZT wafer 84, the uppermost and lowermost gates are identified by reference numbers 11 and 11', respectively. Images of these extreme gates will be projected at points 25 and 25' of the final image 72. The principal central point 13 of collimating lens 38 and gate 11 can be connected by a line 59 which gives the orientation of all the collimated light rays emerging from gate 11, which behaves somewhat like a restricted light source Now, from point 16, a line 59' is traced, parallel with line 59, which intersects the principal plane of lens 38 at point 61. Line 70, connecting this point 61 to gate 11 represents the zero order path of the emerging diffracted rays. The prolongation of the line 70 beyond point 61, not shown in the drawings for clarity's sake, intersects the optical axis at point 16' which represents the virtual imaging point of the rays entering the modulator 28.

Although a graphical representation only of the optical path of some extreme rays have been shown, it is clear that, for a maximum length of line 43, known location of gate 11, known focal length of collimating lens 38 and the space between that lens and lens 42 at home position 42', and the optical characteristics of lens 38, the location of point 16' can be determined by simple mathematics. The distance measured from this point to lens 62 and the configuration of the optics located upstream of lens 62 determine its focal length which is dependant, as shown above, on the maximum length of line, but does not substantially affect light rays emerging from the gates assembly for which it behaves as a field lens.

The path followed by the plus one and minus one orders of the diffracted light are shown in the figure by dashed lines 69 and 71 for gate 11. The angle "i" formed between the zero order ray and the first order diffracted ray can be computed from the well-known formula: $\sin i = \lambda/d$, in which "$\lambda$" is the wave length of light and "d" is the pitch of the column of gates on wafer 84. Thus, the angle of diffracted rays of the first order being know, these rays can be traced and their exact impact on the principal plane of carriage imaging lens 42 can be computed to determine the clear aperature of that lens.

It is noteworthy that all of the rays emerging from the modulator 28 converge to a "waist" located on a plane perpendicular to the optical axis at point 16. Thus, contrary, it is believed, to any system described in the prior art, the light rays emerging from the imaging lens do not continuously diverge, but converge to a point located at mid-course of the maximum travel of said lens, from which they diverge again as shown in the figure. The above described configuration makes it possible to use a relatively small and light imaging lens which enables the projection of long lines at great carriage speed for a relatively small cost.

Figure 5:
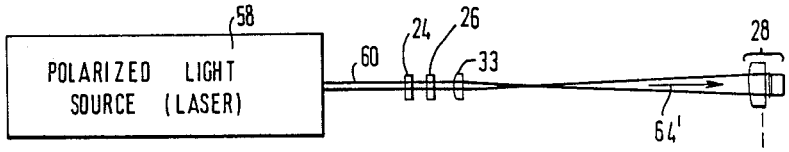
FIG. 5 is a partial section view taken in a second plane perpendicular to that of FIG. 4.
Figure 5A:
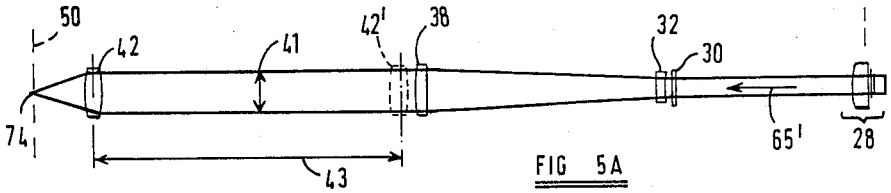
FIG. 5A is a continuation of FIG. 5.

FIGS. 5 and 5A are similar to FIGS. 4 and 4A, except that FIGS. 5 and 5A schematically represent the optics in the horizontal plane. The same reference numbers represent the same components as in FIGS. 4 and 4A. As shown in FIG. 5A, after bouncing back from the modulator 28, the reflected light goes through diverging cylindrical lens 32 and converging spherical lens 38. In the plane of the drawings these two lenses constitute a "flat" telescope (that is affecting rays located in one plane only) whose output is a parallel bundle of light beams as shown at 41. Traveling lens 42 produces, again in the plane of the drawings, a tiny point or dot on the photosensitive media 50, as represented at 74. As noted above, this point, in the embodiment shown, is of the order of 20 microns across.

It is also noteworthy that the column of modulator elements located in the vertical plane and the points forming rays located in the horizontal plane are subjected to quite different optical treatments. In the vertical plane, the diverging "flat" fanning out light rays 64, after twice crossing lens 62 (FIG. 11) converge to make an image of the virtual light source 60' at 16'. All of the light rays emerging from a gate such as gate 11, except diffracted rays of second order and higher, which carry very little light, are channeled to lens 42.

In the horizontal plane, the narrow bundle of rays 60 emerging from the laser 58 are first slightly spread out by cylindrical lens 33 to increase the width of the elongated light patch in order to cover the width 97 (FIG. 12) of the gates assembly. The rays emerging from unit 28 are spread out further in the horizontal plane by cylindrical lens 32 whose purpose is to increase the width of the bundle of light rays so that when they exit collimating lens 38 their width 41 is sufficient to produce a very small point 74 whose size, as is well known in the art, is proportional to the focal length of imaging lens 42 and inversely proportional to the width of beam 41 for a given wave length of the light.

The purpose of the optics affecting the light rays of the vertical plane is to make an image of the gates unit, whereas the optics affecting the rays of the horizontal plane only determine the size and quality of the laser beam as it emerges from those optics.

Going back to the vertical plane, the bundle of rays emerging from lenses 84 and 26 is shown at an enlarged scale in FIG. 6. It has been experimentally found that through the judicious selection of simple cylindrical lenses, the uncorrected aberrations contribute to the formation of an elongated patch of light as shown in FIG. 7, with an area of substantially uniform illumination, shown at 77 in FIG. 7. The height 78 and width 79 of this area are somewhat greater than necessary to cover the effective zone 97 of the gates electrodes shown in FIGS. 12 and 18.

One feature of the invention concerns the path followed by the light-patch forming rays. It has already been stated that light rays pass through the lens 62 twice, and that the focal length of the lens 62 is such that the PLZT wafer 84 is located in the focal plane of the optical arrangement of FIGS. 4 - 4A and 5 - 5A. Because the capacitance of the PLZT gates, they normally should be operated by a so-called "totem pole" circuit in order to obtain a fast response. However, these circuits are relatively expensive and consequently they are to be avoided in a low-cost machine, such as is the objective of the present invention. Consequently, the present arrangement utilizes lower-cost intergrated circuits, as schematically shown at 92 in FIGS. 8 and 10. However, in the present state of the art, these circuits cannot produce the voltage which is necessary to rotate the polarization plane by a full 90 degrees. If 90 degree rotation is not obtained, the light output from the shutter including modulator 24 and polarizer 30 is quite limited. According to this feature of the invention, the light passes through the cermaic wafer 84 twice in order to rotate the plane of polarization by an acceptable amount. The total rotation is equal to approximately twice the rotation produced by a single pass.

ELECTRICAL CONTROL SYSTEM

The upper part 108 of FIG. 19 is a block diagram of the major electrical components of the mcdulator 28 of FIG. 10. A shift register 118 is connected to a clock source by line 120, and receives data on line 122. A latch circuit 116 is provided with its input line 124. A known driver circuit 114 (e.g. Texas Instruments Electroluminescent Column Driver Part No. SN 75555 FN or SN 755556 FN) controls the 256 gates 112-1 to 112-256. Block 110 represents a field inversion control circuit, a known circuit for reversing the transmission of the gates so as to produce white images on a black background instead of black-on-white, for example.

The circuitry in section 108 of FIG. 19 is well known.

In the lower part of FIG. 19 block 128 represents the CPU which controls all the functions of the machine. It is connected to the other major components, such as the information input circuit 126 for data from an external source, to the character generator storage 130, to the photomedia control 134 (for example for film feed), to the block 136 which, through electrical or optical (filters) means, controls the amount of light that can reach the photosensitive material, and finally to the block 32 representing the character forming, projecting and spacing carriage control circuitry. Although not shown in the Figure, it is the motion of the carriage, which, through an encoder or a grating system and associated electronics, controls the opening or closing of preselected gates, as called for by the character generator.

FIG. 20 shows, in greater detail, a preferred embodiment of the electronic control circuitry of the machine described herein. Data is input over input lines 416 or 417. For example, serial data can be transferred over line 416 through a standard connector known as RS-232. For faster and more complex transfer of information in parallel, connection 417 is utilized, particularly for the transfer to the machine of data pertaining to graphical material, including half-tone illustrations.

The information coming from outside sources is transferred via the connections referred to above to the main CPU 395 which interprets the information received and organizes the general sequential operations of the machine in order to produce the desired output on the photosensitive media. The main CPU is connected to a large capacity memory 396 where all the necessary data concerning, for example, the shape of alphanumeric characters, are stored on discs, PROMS or other mass storage media. For the production of alphanumeric characters (or other images), the fonts to be utilized during the operation of the machine are transferred to random access memory (RAM) 394.

The main CPU transfers the shapes of images to a signal processor 397 (for example, Texas Instrument model TMS 32010) which determines the points where the contours of the desired images, for a given size, intersect the background screen to be printed. This data is transferred over line 421 and stored in RAM memory 400 so organized that the ON-OFF changes can be identified without any ambiguity. Thus, block 400 represents a "bit map" of transitions. Its capacity need not be greater than 64 kilobytes representing, on the average, a 2" long line of textual material. This capacity is much smaller than the several megabytes usually required by comparable prior art photocomposers using spinning polygonal mirrors. The reduced storage requirements is one advantage of the present invention.

Signal processor 397 can also, via line 423, send data to bit map storage unit 401, of capacity similar to that of unit 400, which may store information on screening, shapes, pictoral components, etc.

The storage in and retrieval of information from units 400 and 401 is controlled by a standard read/write control circuit 402 which receives over a line 424 timing pulses 111 (FIG. 3) originating from carriage 46. Unit 402, which is controlled by processor 397, can control various logical operations from information received from the bit maps of blocks 400 and 401. For example, logical function NAND enables the output of reversed imagery (white on black background) on an area defined by one of the bit maps. The data serialized by unit 402 is segregated between odd and even and introduced into register 403 which controls the modulator 28 to operate as described above in connection with FIG. 18.

Main CPU 395, taking into account the status of the bit-map units 400 and 401, gives the necessary commands for the operation of carriage 46 through CPU 399 which is dedicated to the command of mechanical functions. CPU 399, subject to manual controls 398, controls the motion of the photoreceptor (film) and all the other functions of the output unit such as: operation of the laser shutter, status of the photoreceptor, film cutter operations, display on information status, instruction keys, motors, etc. The light intensity is also adjusted by this unit so that the light reaching the film is independent of the carriage speed. This result is obtained by adjusting the voltage applied to the electrodes of the modulator 28 by means of a known control circuit 404. In certain cases, the voltage applied to the modulator depends on the mode of operation, for example in the case of reversed output, which generally requires less light intensity to avoid affecting the white (or transparent) areas located on black background.

In FIG. 20, the translating carriage assembly is shown schematically at 46, its rails at 48, and a grating 57 for generating timing pulses is attached to the frame of the machine, as will be explained in greated detail below. A motor 407, together with a pulley 408 and a belt 409 which is secured to the carriage, can move the carriage along rails 48 in either direction under the control of servomechanism control circuit 405 which operates under the control of the CPU 399.

The film 50 (or any other photosensitive media) is driven length-wise for leading by a drive roller 413 through gearing by tachometer 411 and motor 410 controlled by servo mechanism control circuit 406 which, like servo 405, is itself controlled by CPU 399. Leading is performed in the relatively short time it takes the carriage to reverse its direction at the end of each line of composition.

According to another feature of the invention, the accurate measure of the displacement of the film (or its position) is obtained by a light-weight idler roller 414 which is driven by the film itself against which the roller 414 is pressed by springs (not shown). Idler 414, preferably in the form of a tube, can be coated with a thin coating of high-friction material to minimize slippage between the roller and the film. Thus, the roller 424 rotates very freely and transfers its rotation to an encoder assembly shown at 415. The encoder assembly 415 sends a position feedback signal to the servocircuit 406. Means, not shown in the drawings and forming no part of the invention, also are utilized to insure the position of the film in its transverse location along the driving roller and the idler.

CARRIAGE CONSTRUCTION

The carriage 46 supporting the moving optics and its mounting structure are shown schematically in FIGS. 21 and 22.

In FIG. 21, one of the cylindrical guide rails on which the carriage slides is shown at 427. According to a feature of the invention, these rails are relatively flexible. Their position is maintained accurately by pressing each rail, by means of a fastener (not shown) or other means, against an accurate angular recess such as the recess 450 located in a rigid frame 426 which supports the translating carriage assembly 46. The carriage, which is very light-weight, has a bearing member 435 with a V-shaped groove engaging rod 427.

A flexible film-like member 428 is secured to the supporting frame 426 by the pressure of rail 427. The flexible member 428 has a grating in the area 428[1] which extends, as shown, between a light-emitting diode (LED) 430 mounted on the frame 429 of the moving carriage 46, and a multiple-quadrant sensing detector shown at 436 attached to a printed circuit board 434 which also is attached to the frame 429. Thus, as the carriage is moved along its supporting rails, the LED 430 in co-operation with a mask 431 and the detector assembly 436, creates a series of pulses as the equipment moves along the fixed grating 428[1] A small spacer 449 made of Teflon or similar material is located as shown for the purpose of holding the grating at an accurate and fixed distance in relation to the photodetector assembly. The spacer is attached to the moving carriage frame 429 by a fastener 432.

FIG. 22 is a perspective view of the complete assembly of the traveling carriage 46 and its supporting structure. The guide rails are shown at 425 and 427, secured to a rigid frame 426 by fasteners such as tapered-head screws 447 driven in to the wall of the support 426 beside the rods 427 and 425. Two of the bearing blocks 435 with V-shaped grooves are used. Each is made of a low-friction material such as Teflon and is attached to the frame 429 of the carriage 46 so as to engage the rail 427.

Mounted on the frame 429 is the mirror 44 attached to a prism-like block, and the lens 42, mounted on a plate 437 whose position can be adjusted lengthwise by a screw 438 co-operating with a slot 451.

The upper part of the carriage 46 is provided with a tapered, frustro-conically shaped roller 442 which is pushed against upper rail 425 by the combined action of a lever 440 pivoted at 441 on the carriage frame and a tension spring 439. The purpose of this arrangement is to hold the carriage accurately in place on the rails and, to this end, to take up any play between the carriage and its rails. Tapered roller 442 tends to push the carriage down against the rail 427, and also holds friction-reducing Teflon pads 443 against the rail 425 to hold the carriage accurately in contact with its guide rails.

The use of a relatively low-friction, long-wearing material such as Teflon for the bearing surfaces 435, 443 is advantageous in that it provides some resistance to travel, which tends to dampen unwanted vibrations, and is very accurate.

The carriage is moved along its rails by a cable 445 co-operating, as shown, with a capstan 444 driven by a motor which is not shown in FIG. 22 but is shown at 407 in FIG. 20. The driving cable 445 is attached to the carriage frame by a screw 446. The grating-supporting flexible strip is shown at 428 and the grating at 428[1]. Flexible electrical cables 448 are provided to conduct electrical signals to and from the carriage 46.

Preferably, the frame 426 has the shape of an elongated, generally U-shaped metal beam with walls shaped to form the angular recesses 450 into which the rods 425, 427 are secured. A lower channel portion 426[1] (FIG. 22) is provided to accommodate the lower parts 430 (FIG. 21) etc. of the carriage 46. Surprisingly, an ordinary extruded aluminum beam has sufficient linearity and accuracy to serve as the support 426 for ordinary ground, flexible steel rods used as guide rails 425, 427. This helps to keep the cost of the machine low.

OPTICAL ALIGNMENT

According to another feature of the invention, means are provided for accurate alignment of the optical components shown in FIG. 2. The support structure for cylindrical lens 24 is adapted to allow the lens to be moved as shown by arrow 51 (FIG. 2) in order to adjust the uniformity of the elongated light beam. Similarly, lens 26 also can be moved vertically as indicated by arrow 53 in order to vertically position the elongated light beam.

Cylindrical lens 33 can be adjusted in the horizontal plane as shown by arrow 35 to position the elongated light beam at the proper position on light modulator assembly 28. Collimating lens 38 can be moved in the direction of beam 54, as indicated by arrow 55, in order to get the exact reduction ration desired to compensate for the tolerances of the subsequent optical and mechanical components.

From the foregoing, it can be seen that the machine and method of the invention amply meet the objectives set forth above. The machine is fast, compact and relatively simple and inexpensive to manufacture, and yet it produces composition of relatively high quality.

The above description of the invention is intended to be illustrative and not limiting. Various changes or modifications in the embodiments described may occur to those skilled in the art and these can be made without departing from the spirit or scope of the invention.

I claim:

1. A photocomposing method for recording information on a photoreceptor comprising the steps of forming a thin, elongated polarized light beam, projecting said light beam into a light shutter unit comprising a linear column of coterminous individually controllable elementary areas located on a common substrate of polarization-altering material, and an output polarizing filter, selectively affecting the passage of light through said unit by selective energization of said coterminous elementary areas, directing emerging light rays to a stationary collimating optical system, directing the collimated light rays emerging from said optical system to an imaging second optical system, moving said second optical system in a direction perpendicular to the illuminated linear areas of said substrate, and controlling said selectively affected light through said shutter unit by the motion of said second optical system in order to build up images.

2. A photocomposing method for recording information on a photoreceptor comprising the steps of forming a thin, elongated polarized light beam, projecting said light beam onto a light shutter unit comprising individually controllable elementary areas located along a column on a common substrate of polarization-altering material and an output polarizing filter, selectively affecting the passage of light through said unit by selective energization of said coterminous elementary areas, directing unaffecting emerging light rays to a stationary collimating optical system to an imaging second optical system, moving said second optical system at a substantially constant speed along a straight line in a direction parallel to a photosensitive surface and an optical distance from said surface substantially equal to the focal length of said light shutter in synchronism with the motion of said second optical system so that characters are formed in said photosensitive surface by the juxtaposition of linear elementary images of selected coterminous areas projected and spaced on said surface by the moving second optical system.

3. A method according to claim 1 or 2 in which the light source is a laser.

4. A method according to claim 1 or 2 in which the moving imaging optical system controls the shutter elements by feeding back to the control circuit pulses generated within said system.

5. A method according to claim 1 or 2 in which the light emerging from said laser is directed through an asymetrical beam expander in order to produce a narrow elongated illuminating light beam.

6. A method according to claim 1 or 2 in which the light gate is located between two crossed polarizers.

7. A method according to claim 1 or 2 in which the elongated beam of light impinging on the light shutter is caused to be of substantially uniform intensity by properly combining the aberrations of two simple lenses.

8. A method according to claim 1 in which the light shutter includes a transparent PLZT ceramic wafer provided with a plurality of electrodes to define contiguous light gates whereby voltages can selectively be applied to said electrodes to control said light gates.

9. A method according to claim 8 in which said electrodes are obtained by photolithography and are so shaped and located to insure a substantially uniform illumination of the projected images by avoiding the projection of shadows caused by said electrodes between contiguous energized elementary light gates.

10. A method according to claim 2 in which the ceramic wafer is combined with a reflective surface on one side, positioned in the optical path so that the light entering the wafer is reflected along a path slightly angled relative to the entering path whereby the emerging light, having crossed the wafer twice is directed toward the image forming optics.

11. A method according to claim 2 in which alphanumeric characters are projected onto the light sensitive surface one after another in rapid sequence by energizing in succession the gates corresponding to adjacent slices of each character.

12. A photocomposing method for recording information on a photoreceptor comprising the steps of forming a single laser beam, directing said laser beam to a fixed asymetrical beam expander to form a wide brush beam, directing said expanded wide brush beam to a stationary optical beam manipulator assembly capable of dividing said beam into multiple secondary beams of individually altered polarization located on a common plane and using a polarizer for selectively blocking the transmission of some of said secondary beams while transmitting others of said secondary beams to scanning means, and scanning the transmitted secondary beams relative to said photoreceptor while controlling said transmitting step in synchronism with said scanning step to form images from spots assembled on said photoreceptor.

13. A photocomposing device for forming, on a photosensitive recording surface, images composed of a plurality of relatively small spots assembled together in accordance with a pre-determined pattern, said device comprising, in combination, wide-brush laser beam-forming means for forming a laser beam which is at least as wide in one direction as the length of a line formed by a plurality of said spots aligned serially, modulator means for breaking said beam into samll portions and selectively transmitting said portions of said beam to said surface to form spots thereon, modulator means comprising an array of adjacent electro-optical gates on a substrate for selectively transmitting light therethrough in response to the receipt of an electrical signal, and means for selectively applying electrical signals to said gates in synchronism with the sweeping of said beam relative to said recording surface, the width of said beam being at least sufficient to form, during one sweep across said surface, a full line of alphanumeric characters and means for sweeping said beam relative to said recording surface in a direction transverse to said one direction while selectively controlling the transmission of said small portions of said beam to said recording surface and thereby forming and assembling spots into images on said recording surface.

14. A device as in claim 13 in which said wide-brush laser beam-forming means includes laser beam forming means and a beam expander for expanding said laser beam in at least said one direction prior to said beam reaching said modulator means.

15. A device as in claim 13 in which said modulator means includes a body of electro-optic material responsive to electrical signals for modifying the transmission of incident light, a plurality of interleaved electrodes on said body with spaces therebetween, laterally spaced portions of said electrodes being offset from one another in a direction transverse to the direction of said line, whereby adjacent ones of said spots are substantially contiguous or overlapping on said recording surface.

16. A device as in claim 15 including means for laterally compressing the light rays transmitted through each of said gates to form the transmitted light rays into a relatively compact spot.

17. A device as in claim 15 in which said body is made of PLZT material, and including at least one polarizer in the optical path of light from said laser beam-forming means, the plane of polarization of said polarizer being rotated from that of the material when not subjected to a gate-opening electrical voltage so as to normally effectively block the transmission of light through said polarizer, and the polarization plane of said material being rotated sufficiently by an application of said voltage to transmit light therethrough.

18. A device as in claim 15 including means for positioning said body in the path of laser beam, reflector means adjacent said body for reflecting transmitted beams back through said body to be subjected to modulating action twice.

19. A device for forming lines of images on a photosensitive surface in a photocomposing machine, said device comprising, in combination, forming means for forming shaped light rays representative of said images or parts thereof, converging lens means for causing said light rays to converge, collimating means for collimating said light rays, a carriage, a focusing lens and reflector combination mounted on said carriage, and means for mounting said carriage to travel parallel to said photosensitive surface and to the central axis of the collimated light rays from said collimation means, with said lens and reflector combination intercepting said collimated light rays, reflecting them through an angle of 90°, and focusing them on said photosensitive surface.

20. A device as in claim 19 having a predetermined maximum length for said lines and a corresponding first and second extreme positions of travel of said lens and reflector combination, said converging lens means being adapted to cause said light rays to converge to a point located approximately half-way between said extreme positions of travel.

21. A device as in claim 19 in which said forming means is adapted to cause said light rays to form a line varying in height according to a predetermined program relating said height to the position of said carriage at a given instant, said line extending in a direction transverse to the direction of travel of said carriage.

22. A device as in claim 21 in which said forming means includes a laser beam source and modulator means for modulating the laser beam from said source.

23. A device as in claim 22 in which said modulator means includes electro-optic shutter means forming a plurality of contiguous light gates dividing said laser beam into a plurality of contiguous spot-forming beams, and means for selectively opening and closing each of said light gates to form said images by assembling said spots on said photosensitive surface.

24. A device as in claim 21 in which said line is aligned with the optical axis of said collimated light rays.

25. A device as in claim 19 in which said images include alphanumeric characters and symbols.

26. A device as in claim 23 in which said laser beam source includes laser beam forming means and a beam expander for expanding said laser beam in at least said one direction, and in which said modulator means includes a body of electro-optic material responsive to electrical signals for modifying the transmission of incident light, and a plurality of interleaved electrodes on said body with spaces therebetween

27. A device as in claim 26 in which laterally spaced portions of said electrodes are offset from one another in a direction transverse to the direction of said line, whereby adjacent ones of said spots are substantially contiguous or overlapping on said recording surface.

28. A device as in claim 27 in which said body is made of PLZT material, and including at least one polarizer in the optical path of light from said laser beam-forming means, the plane of polarization of said polarizer being rotated from that of the material when not subjected to a gate-opening electrical voltage so as to normally effectively block the transmission of light through said polarizer, and the polarization plane of said material being rotated sufficiently by an application of said voltage to transmit light therethrough, and including means for positioning said body in the path of laser beam, reflector means adjacent said body for reflecting transmitted beams back through said body to be subjected to modulating action twice.

29. A method of photographically composing relatively long lines of images on a photosensitive surface, said method comprising the steps of shaping light rays to form said images or parts thereof, causing said light rays to converge, collimating said light rays, and moving a focusing lens and reflector combination in a direction parallel to said photosensitive surface and to the optical axis of the collimated light rays in order to form images at spaced locations in lines on said surface.

30. A method as in claim 29 in which the step of causing said light rays to converge includes causing them to converge approximately at a point midway between the extreme positions of said lens and reflector combination for composition in a line of a predetermined maximum length.

31. A method as in claim 29 in which shaping step includes directing a laser beam onto a multiple electro-optic light gate array which divides the laser beam into spot-forming beams, and selectively opening and closing said gates to form spots on said surface in synchronism with the movement of said lens and reflector combination.

32. A method as in claim 31 including arranging said spot-forming beams to form a line of said spots, said line being of varying length, said line being located on said optical axis.

33. A method as in claim 32 in which said array includes a plurality of spaced-apart opaque electrodes on a electro-optic light polarization body, and a cross polarizer, laterally-spaced portions of said electrodes being offset from one another in the direction of said line so as to create light beam portions which are contiguous with or overlap adjacent light beam portions so that a series of such portions aligned together form a substantially continuous line.

34. A photocomposing device for forming images on a photosensitive surface, said device, comprising, in combination, a laser beam source, modulating means comprising a linear array of closely-spaced electrodes on a substrate, each electrode being independently responsive to an electrical signal to control a small portion of the laser beam from said source, said array thus forming a relatively wide-brush linear beam composed of small, independent laser beams capable of forming closely-spaced spots on said photosensitive surface when directed therto, means for directing a laser beam from said source to said modulating means, translating means for projecting said wide-brush beam onto said photosensitive surface and creating movement of said translating means and said photosensitive surface relative to one another in a direction transverse to the direction of the linear array of beams in said brush, and movement of said translating means parallel to said surface, means for directing said wide-brush beam from said modulating means to said translating means, and means for controlling the energization of said electrodes in synchronism with said movement in order to form said images from said spots.

35. A device as in claim 34 in which the movement of said translating means parallel to said surface is in a direction transverse to said direction of said linear array of beams in said brush.

36. A device as in claim 34 in which said substrate comprises a material responsive locally to electrical voltages in order to change the polarization of incident polarized light, said modulating means including polarizer means for blocking the transmission of beams reflected from said substrate with a pre-determined polarization state.

37. A device as in claim 36 in which said material is PLZT material.

38. A photocomposing device for forming lines of images of alphanumeric characters forming text matter on a photosensitive surface, said device comprising, in combination, a laser beam source, modulating means for modulating a laser beam from said source and forming a relatively wide-brush linear beam composed of small, independent laser beams capable of forming closely-spaced spots on said photosensitive surface when directed thereto, said modulating means including means for independently controlling each of said small beams in response to electrical control signals, means for directing a laser beam from said source to said modulating means, translating means for projecting said wide-brush beam onto said photosensitive surface and creating movement of said translating means and said photosensitive surface relative to one another in a direction transverse to the direction of the linear array of beams in said brush, and movement of said translating means parallel to said surface, means for directing said wide-brush beam from said modulating means to said translating means, said translating means including a lens and reflector mounted on a carriage which is movably mounted on guide means for reciprocating motion across said photosensitive surface parallel to said surface, and means for delivering to said modulating means electrical signals representative of said alphanumeric characters to thus form alphanumeric character images and text matter on said photosensitive surface.

39. A device as in claim 38 in which said modulating means includes a wafer of electrical signal-responsive polarization altering material with plural closely-spaced electrodes thereon, and a polarizer for blocking those beams with a pre-determined polarization.

40. A modulator device for modulating laser beams used in forming images, said device comprising a wafer of PLZT material with a plurality of closely-spaced electrodes forming an array on one surface of said wafer, said electrodes being interleaved with one another with elongated spaces therebetween, laterally-spaced portions of said electrodes being offset from one another in a direction transverse to the spaces therebetween, whereby a laser beam incident upon said array is divided into a plurality of smaller laser beams the polarization of each of which is controllable by a pair of adjacent ones of said electrodes to form a substantially unified beam.

41. A device as in claim 40 including a polarizer intercepting light beams emerging from said wafer and blocking those beams with a pre-determined polarization.

42. A device as in claim 40 including a reflecting surface adjacent one surface of said wafer so as to reflect beams back through said wafer to subject them to the effects of said wafer twice before emerging from said wafer.

* * * * *